US005653098A

United States Patent [19]

Stahlecker et al.

[11] Patent Number: 5,653,098

[45] Date of Patent: Aug. 5, 1997

[54] RING SPINNING MACHINE WITH SLIVER FEED SYSTEM

[76] Inventors: Fritz Stahlecker, Josef-Neidhart-Strasse 18, 7347 Bad Überkingen; Hans Stahlecker, Haldenstrasse 20, 7334 Süssen, both of Germany

[21] Appl. No.: 352,716

[22] Filed: Nov. 4, 1994

Related U.S. Application Data

[63] Continuation of Ser. No. 886,813, May 22, 1992, abandoned.

[30] Foreign Application Priority Data

Aug. 20, 1991 [DE] Germany ..... 41 27 490.3

[51] Int. Cl.[6] ..... D01H 13/04

[52] U.S. Cl. ..... 57/90; 57/58.7

[58] Field of Search ..... 57/90, 264, 113, 57/156, 308, 352, 58.7; 19/150

[56] References Cited

U.S. PATENT DOCUMENTS

| | | | |
|---|---|---|---|
| 3,073,106 | 1/1963 | Tsuzuki | 57/308 |
| 3,312,050 | 4/1967 | Noguera | 57/90 |
| 3,816,991 | 6/1974 | Takeuchi et al. | 57/91 |
| 4,809,495 | 3/1989 | Condotta | 57/90 X |
| 4,905,467 | 3/1990 | Gabalda | 57/90 X |
| 4,988,325 | 3/1991 | Staheli et al. | 19/150 X |
| 5,014,398 | 5/1991 | Stahlecker | 19/244 |
| 5,140,722 | 8/1992 | Akiyama | 19/157 |

FOREIGN PATENT DOCUMENTS

| | | |
|---|---|---|
| 817572 | 8/1951 | Germany . |
| 887015 | 7/1953 | Germany . |
| 1164889 | 9/1964 | Germany . |
| 1015780 | 1/1966 | United Kingdom . |

*Primary Examiner*—C. D. Crowder
*Assistant Examiner*—Larry D. Worrell, Jr.
*Attorney, Agent, or Firm*—Evenson McKeown Edwards & Lenahan PLLC

[57] ABSTRACT

For the direct spinning of drafting frame sliver, a one-sided ring spinning machine is provided, in the case of which the spinning stations are arranged on one side of the machine and the depositing sites for the cans containing the sliver to be spun are arranged on the other side of the machine. For the withdrawing of the slivers, a drivable deflecting guide is provided closely above the cans which is situated at least approximately in the same horizontal plane as the drivable feeding rollers of the pertaining drafting units. Preferably, the deflecting guide is formed by a transport belt which transports the slivers from the cans to the drafting units. Preferably, the transport belt has a linear course and is driven by the drivable feeding roller of the pertaining drafting unit.

33 Claims, 6 Drawing Sheets

10
12
14
16
11
9'
8'
7'
6'
44
46
52
48
50
51
41
47
45
43
49
40
42
28
27
5
26
15
4
29
35
30
6
31
32
2
34
33
13
36
37
38
39

RING SPINNING MACHINE WITH SLIVER FEED SYSTEM

This application is a continuation of application Ser. No. 07/886,813 filed on May 22, 1992 now abandoned.

BACKGROUND AND SUMMARY OF THE INVENTION

This invention relates to a ring spinning machine comprising spinning stations which are arranged on one side of the machine next to one another in a row and each contain a drafting unit, and comprising depositing sites for cans containing sliver to be spun provided on the other side of the machine and joined directly to the ring spinning machine.

In the case of a ring spinning machine of this type (German Patent Document DE-PS 887 015), the overall width of the ring spinning machine is reduced to approximately half the overall width of the otherwise customary two-sided ring spinning machines so that the ring spinning machines can be set up in groups or pairs in an arbitrary arrangement with respect to one another. The originally one-sided ring spinning machines in this case can be set up in such a manner that at the rear of the ring spinning machine a base is provided which enlarges its standing surface and on which the depositing sites of a row of cans are provided (FIG. 2). It remains open how the slivers are transported from the cans to the spinning stations.

In the case of a two-sided ring spinning machine to which a sliver is fed in cans, partitionless cans having normal dimensions are provided, each of which contain at least four slivers and which are arranged between the rows of drafting units (German Patent Document DE-PS 817 572). In this case, the cans are deposited in an elevated manner on a table arranged above the driving drum or on a conveyor belt arranged above the driving drum in the area of the longitudinal center plane of the ring spinning machine. By way of fixed or rotating guides, the withdrawn slivers are guided to the drafting units in the vertical direction.

On the basis of the German Patent Document DE-PS 11 64 889, a ring spinning machine is known which has an aisle in its interior serving as the operating platform, at both sides of which the drafting units and the rows of spindles are arranged—facing the aisle. In this case, the floor of the aisle is fastened to the machine frame. For each side of the machine, the cans are deposited in four rows underneath the aisle. The slivers are withdrawn in the upward direction and are transported to the drafting units suspended freely along an extremely long path.

On the basis of the British Patent Document GB-PS 10 15 780, a ring spinning machine is known in the case of which the slivers are transported from the cans to the spinning stations by means of transport belts. A second transport belt is assigned to each transport belt so that transport belt pairs are formed which each receive and transport a sliver between one another. The slivers are withdrawn from the cans by way of rollers arranged above them, are transported vertically downward, are conveyed below the floor to the ring spinning machine and are guided from there diagonally upward approximately to the machine center, and farther to the drafting units.

When ring spinning machines spin the slivers fed in cans directly into yarns while eliminating the flyers which are normally connected in front of them, there is the danger that the slivers hang out; that is, are drafted uncontrollably because of their own weight. In practice, ring spinning machines with can feeding have therefore been used only for such slivers which have a relative coarse size and therefore a relatively high strength. However, the spinning of slivers of coarse sizes is very difficult on ring spinning machines since such machines permit only a relatively low delivery speed at the outlet of the drafting units. While the required draft is taken into account, when coarse slivers are fed, the feeding rollers of the drafting units therefore rotate very slowly, that is, at rotational speeds of less than one rotation per minute. Technically, it is extremely difficult to let long drive shafts rotate with sufficient precision at such low rotational speeds, as they are used as feeding rollers of drafting units. There is the risk that these shafts rotate only jerkily so that no controlled draft is obtained.

It is an object of the invention to arrange the depositing sites for the cans in the case of a ring spinning machine of the initially mentioned type in such a manner that the transport paths for the slivers are designed such that finer slivers than previously can be spun into yarns while the space requirements are acceptable.

This object is achieved according to preferred embodiments of the invention in that, for the withdrawing of the slivers, a drivable deflecting guide is provided closely above the cans which is disposed at least approximately in the same horizontal plane as the drivable feeding roller of the pertaining drafting unit.

Even if the cans are deposited in several rows, the transport paths remain so short that damaging free hanging lengths are normally avoidable. As a result, it is possible to also feed relatively thin slivers in cans, that is, slivers of sizes of approximately Nm 0.3 to 0.8. Because of these fine sizes of the slivers, the feeding roller pairs of the drafting units, while the draft is taken into account, can still run at a sufficiently high speed so that a uniformly round rotating is ensured. There is the additional advantage that the three-cylinder drafting units can be used which are customary nowadays in the case of ring spinning machines.

The one-sided ring spinning machine according to the invention may be extremely narrow. The overall height of the drafting units may be arranged in such a manner that, after their withdrawal from the cans and their first deflection, the slivers have to travel along a short horizontal path.

In a further development of the invention, the cans may be deposited on a can platform which is elevated in comparison to the floor of the ring spinning machine. As a result, it is possible to provide the open top side of the cans at a height that results in the shortest path for the slivers to reach the drafting units. Outside diameters of the cans of maximally 300 mm are advantageous as well as a height of the drivable feeding rollers of the drafting units of maximally 1.4 m measured from the floor of the ring spinning machine.

In the case of a further development of the invention, the deflecting guide is a delivery roller. The slivers transported from the deflecting guide to the feeding rollers will then travel through a sufficiently short free hanging length. This development is particularly suitable for slightly coarser slivers.

In another development, the deflecting guide is a deflecting roller around which a drivable transport belt is wound. This development makes it possible, particularly when several rows of cans are present, to bridge a slightly longer transport path without the occurrence of faulty drafts. This development is suitable particularly in the case of very fine slivers.

The transport belts are expediently designed in such a manner that they have a linear course and extend at least approximately to the drivable feeding roller of the drafting unit. In a particularly preferred development, the transport belt winds around the drivable feeding roller and is driven by it. As a result, a separate drive for the transport belts is not necessary.

Expediently, the transport belt is provided with a shield against side air. As a result, it becomes possible to make the transport belts sufficiently narrow without the risk that the transported slivers are blown laterally off the transport belts. Preferably, the shield is constructed as a skid which, in addition to providing protection against side air, also ensures a certain ironing effect which stretches and smoothes the slivers.

In an advantageous development of the invention, the deflecting roller is arranged on an upwardly swivelling frame. As a result, it is possible, also in the case of a low overall height of the ring spinning machine, to carry out manipulations at the rows of cans situated closest to the ring spinning machine without any hinderance of the operating personnel caused by the deflecting rollers assigned to the outside rows of cans. In this case, the deflecting rollers may expediently be a component of a tensioning device tensioning the transport belt.

In a preferred development of the invention, the drivable feeding rollers of the drafting units are arranged as closely as possible to the rear side of the ring spinning machine. This measure contributes to the fact that the free hanging length of the transported slivers can be made particularly short so that faulty drafts are avoided. In this case, it is advantageous for the drafting units to be arranged at a slope of approximately 45 degrees with respect to the horizontal plane.

Preferably, the drivable feeding rollers of the drafting units are constructed as rollers which can be decoupled from a drive shaft. In particular, when the feeding rollers also drive the transport belt transporting the sliver, in the case of a yarn breakage, the feeding rollers and the transport belt can therefore be stopped simultaneously in a simple manner. This has the advantage that, after the elimination of the yarn breakage, the slivers do not have to be newly threaded into the drafting unit. Expediently, in this case, the pressure rollers of the drafting units pertaining to the drivable feeding rollers are constructed as loose rollers of a pressure roller pair. Nowadays, pressure roller pairs represent the customary design in the case of drafting units, and the arrangement as loose rollers makes it possible to stop one pressure roller of the pressure roller pair without interfering with the other pressure roller.

Advantageously, one feeding hopper respectively is connected in front of the drivable feeding rollers for lifting the sliver off the transport belt. As a result, it is ensured that the slivers enter into the feeding roller pairs of the drafting units at the correct point of the pressure roller coatings. It is contemplated that the path along which the sliver is lifted off the transport belt should be as short as possible so that faulty drafts are avoided.

In a case in which the transport of the slivers is not interrupted because of a yarn breakage, it is expedient to assign a sliver deflector to the running transport belt. This will be particularly expedient when a new sliver must be fed after a batch change. It will then be possible to deflect the slivers temporarily from their operational path without having to stop the transport belt and the drafting units.

Advantageously, the depositing sites of the cans are arranged on a conveyor belt. As a result, it becomes possible to automate the supply and the removal of the cans, a can exchange advantageously taking place in blocks.

In an advantageous development of the invention, an air-conditioning duct is assigned to the depositing sites of the cans. The compact placing of the cans with respect to the one-sided ring spinning machine permits an arrangement of an air-conditioning duct that air-conditions the slivers on their transport path to the drafting units. Advantageously, the air-conditioning duct may be arranged in an air-conditioning tunnel which covers the depositing sites of the cans situated between two ring spinning machines. It therefore becomes superfluous to air-condition the whole spinning room.

Other objects, advantages and novel features of the present invention will become apparent from the following detailed description of the invention when considered in conjunction with the accompanying drawings.

DETAILED DESCRIPTION OF THE DRAWINGS

Figure 1:
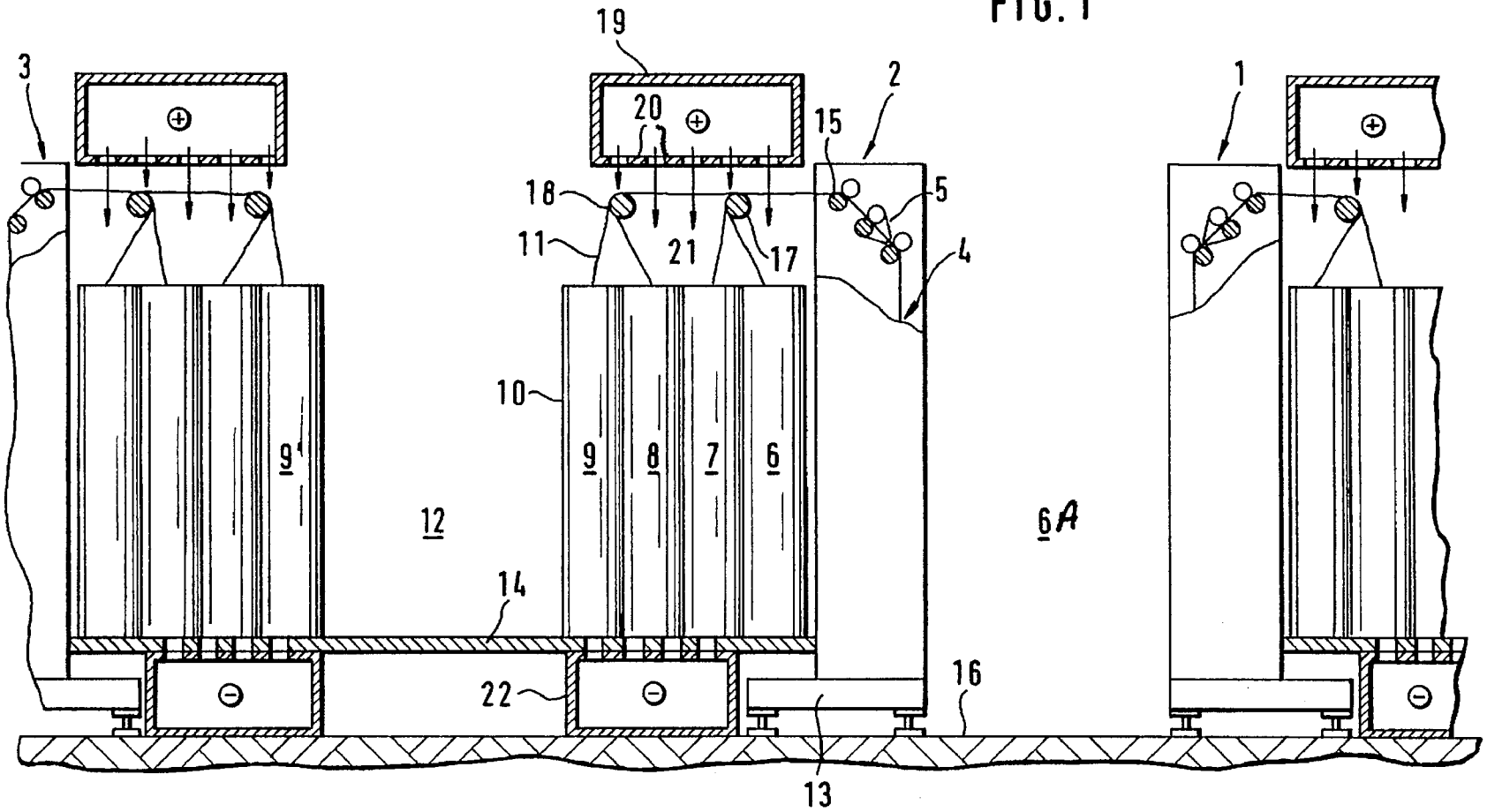
FIG. 1 is a lateral schematic view of a machine system according to the invention comprising several ring spinning machines, in the case of which, the spinning stations are arranged on one side of the machine and the cans for the sliver to be spun are arranged on the other side of the machine in several rows directly joining on the other side of the machine.

In the case of the machine system illustrated schematically in FIG. 1, three ring spinning machines 1, 2 and 3 are set up next to one another in such a manner that two operating sides of the ring spinning machines 1 and 2 and two rear sides of the ring spinning machines 2 and 3 respectively face one another.

The construction of the ring spinning machines 1, 2 and 3 is one-sided; that is, the spinning stations 4, of which only one drafting unit 5 respectively is shown, are arranged next to one another on only one side of the machine of each ring spinning machine 1, 2 and 3. On the operating sides, an operating aisle 6A is left open between the ring spinning machines 1 and 2.

Directly joining to the rear side of each ring spinning machine 1, 2 and 3, a total of four rows 6, 7, 8 and 9 of cans 10 respectively are deposited on depositing sites. The cans 10 contain the sliver 11 from which the yarn is spun in the spinning stations 4. Another aisle 12, the so-called can aisle, is left open between adjacent rows 9 and 9' of two adjacent spinning machines 2 and 3.

So that the ring spinning machines 1, 2 and 3, which are constructed to be extremely narrow, will have a sufficiently stable standing capacity, the respective standing base 13 is constructed to be widened in the direction of the can aisle 12. So that the respective standing base 13 will not hinder the operating personnel, the can platform 14 is constructed to be slightly elevated in the area of the can aisle 12 so that the respective standing base 13 is situated below the can platform 14.

In the arrangement of the ring spinning machines 1, 2 and 3, their construction as well as the arrangement of the rows 6, 7, 8 and 9 of the cans 10 is such that finer slivers 11 can be spun than was previously customary. As a rule, these slivers 11 should not be coarser than Nm 0.3 and may possibly have sizes of up to Nm 0.8. Preferably, slivers 11 made of a combed material are fed.

The drafting units 5 are three-cylinder drafting units which draft the slivers 11 up to 220 times. This becomes possible because of the fact that the slivers 11, on the one hand, are sufficiently fine and that, on the other hand, they do not have the flyer twist which was customary previously.

The one-sided ring spinning machines 1, 2 and 3 have a width of less than 700 mm. The height of the drivable feeding rollers 15 of the drafting units 5 is not more than approximately 1.4 m above the floor 16. The outside diameter of the cans 10 is maximally 300 mm. In the case of a spacing of the spinning stations 4 of maximally 75 mm in the longitudinal direction of the machine, four rows 6, 7, 8 and 9 of cans 10 are therefore required. The rows 6 to 9 of the cans 10 closely join the rear side of the respective ring spinning machine 1, 2 and 3. This ensures a short path of the slivers 11 from the cans 10 to the drivable feeding rollers 15 of the drafting units 5.

In the case of this concept, it is possible in many cases to do without special transport devices for the slivers 11 between the cans 10 and the drafting units 5 because all measures were taken to keep the respective path short. The smaller the diameter of the cans 10 and the narrower the ring spinning machines 1, 2 and 3 are constructed, the shorter the transport path of the slivers 11. In this case, it may be advantageous for the cans 10 to be placed slightly higher on the rear side of the respective ring spinning machine 1, 2, and 3; that is, to deposit them on a can platform 14 so that the path between the slivers 11 and the drafting units 5 becomes still shorter. Two drivable delivery rollers 17 and 18 will then be sufficient for the four can rows 6 to 9. One delivery roller 17 and 18 respectively is situated approximately in the center between two rows 6 and 7 or 8 and 9 of the cans 10, specifically at a small distance above the cans 10. From the delivery rollers 17 and 18, which withdraw the sliver 11 from the cans 10 and serve as the deflecting guide, the slivers 11 extend to the feeding rollers 15 of the drafting units 5 essentially in the same horizontal plane. The delivery rollers 17 and 18 may be arranged on a continuous drivable shaft, but it may be expedient to be able to stop the delivery rollers 17 and 18 separately for each spinning station 4.

Since the ring spinning machines 1, 2 and 3 are very low, the operating personnel have a very good overview from the operating aisle 6 as well as from the can aisle 12. If necessary, the operating personnel can look into the cans 10 from the operating aisle 6, but can at least determine whether the cans 10 are still sufficiently filled.

Closely above the horizontal plane, in which the slivers 11 travel to the feeding rollers 15, one air-conditioning duct 19 respectively is provided above the rows 6 to 9 of the cans 10, air-conditioned air 21 being capable of flowing out of their perforated bottoms. Since the feeding rollers 15 of the drafting units 5 run relatively slowly and thus the slivers 11 are transported very slowly below the air-conditioning ducts 19, there is sufficient time to air-condition the slivers 11 on their transport path; that is, to provide them with the correct temperature and possibly also with an appropriate air humidity.

In the area of the rows 6 to 9 of the cans 10, the can platform 14 is perforated by perforations 20 so that the air-conditioned air 21 can flow off into suction ducts 22 situated underneath the can platform 14. The suction ducts 22 are situated between the floor 16 and the can platform 14 so that it is not necessary to embed the suction ducts 22 in the floor 16.

Because, in contrast to the conventional arrangement, there are no more spool creels, and there is no longer the necessity of arranging possible air-conditioning ducts 19 above these spool creels, the height of the ceiling of the spinning rooms can be reduced considerably. The height will now only depend on the operating personnel so that a ceiling height of 2.2 to 2.3 m will easily be sufficient. This reduces the costs of the space volume as well as those of the air-conditioning.

One-sided ring spinning machines 1, 2 and 3 with the described arrangement of cans 10 do not have any higher space requirement than classical two-sided ring spinning machines where the cans 10 are arranged on the floor 16. The higher space requirement in comparison to those constructions where the cans 10 are arranged below or above the ring spinning machines is at least partially compensated by the fact that the overall height of the spinning rooms can be markedly reduced.

Figure 2:
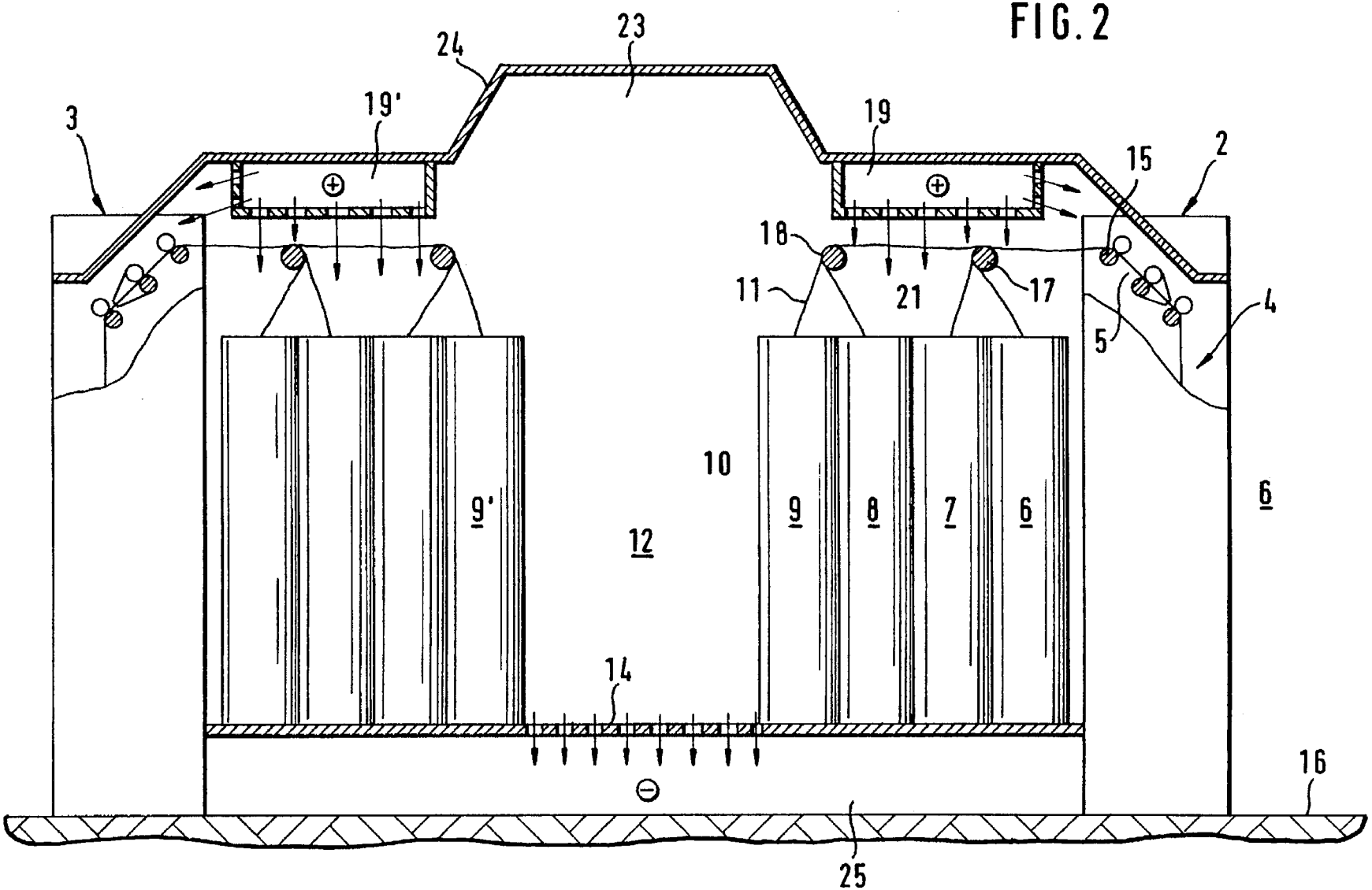
FIG. 2 is a view similar to FIG. 1 showing another preferred embodiment of the invention with an air-conditioning tunnel provided in the area of the cans.

In a further development as compared to the arrangement of FIG. 1, FIG. 2 shows an air-conditioned can tunnel, a so-called air-conditioning tunnel 23. It comprises essentially a roof 24 which covers the two rear sides of two adjacent ring spinning machines 2 and 3. The air-conditioning tunnel 23 therefore essentially comprises only the area of the cans 10 and is formed by the can platform 14, the two rear sides of the ring spinning machines 2 and 3 as well as by the roof 24. Inside the air-conditioning tunnel 23, the air-conditioning ducts 19 and 19' are disposed directly above the cans 10. Air-conditioned air 21 flows onto the cans 10 as well as particularly onto the slivers 11 which travel to the pertaining drafting unit 5.

An excess pressure is formed in the air-conditioning tunnel 23. The can platform 14 is perforated at least in the area of the can aisle 12. Thus the air-conditioned air 21 enters into a vacuum duct 25 which is formed by the floor 16, the can platform 14 and the sheet metal walls of the rear sides of the ring spinning machines 2 and 3. A separate vacuum duct is therefore not required.

The roof 24 ends in the proximity of the drafting units 5. The air-conditioning ducts 19 and 19' may also be perforated laterally so that air-conditioned air can also flow to the drafting units 5.

This development is much more cost-effective than an air-conditioning of the spinning room. Advantageously, the room air is controlled in such a manner that the air-conditioning is maximal in the area of the cans 10 while in the remainder of the spinning room, thus also in the area of the operating aisles 6, only a normal temperature is maintained which is pleasing to the operating personnel. The air-conditioning is therefore effective only where it is important with respect to the spinning technology, but at that point it is particularly precise. Since the travel of a sliver 11 from the can 10 to the drafting unit 5 requires at least 10 minutes, this time is sufficient for perfectly air-conditioning the sliver 11.

Figure 3:
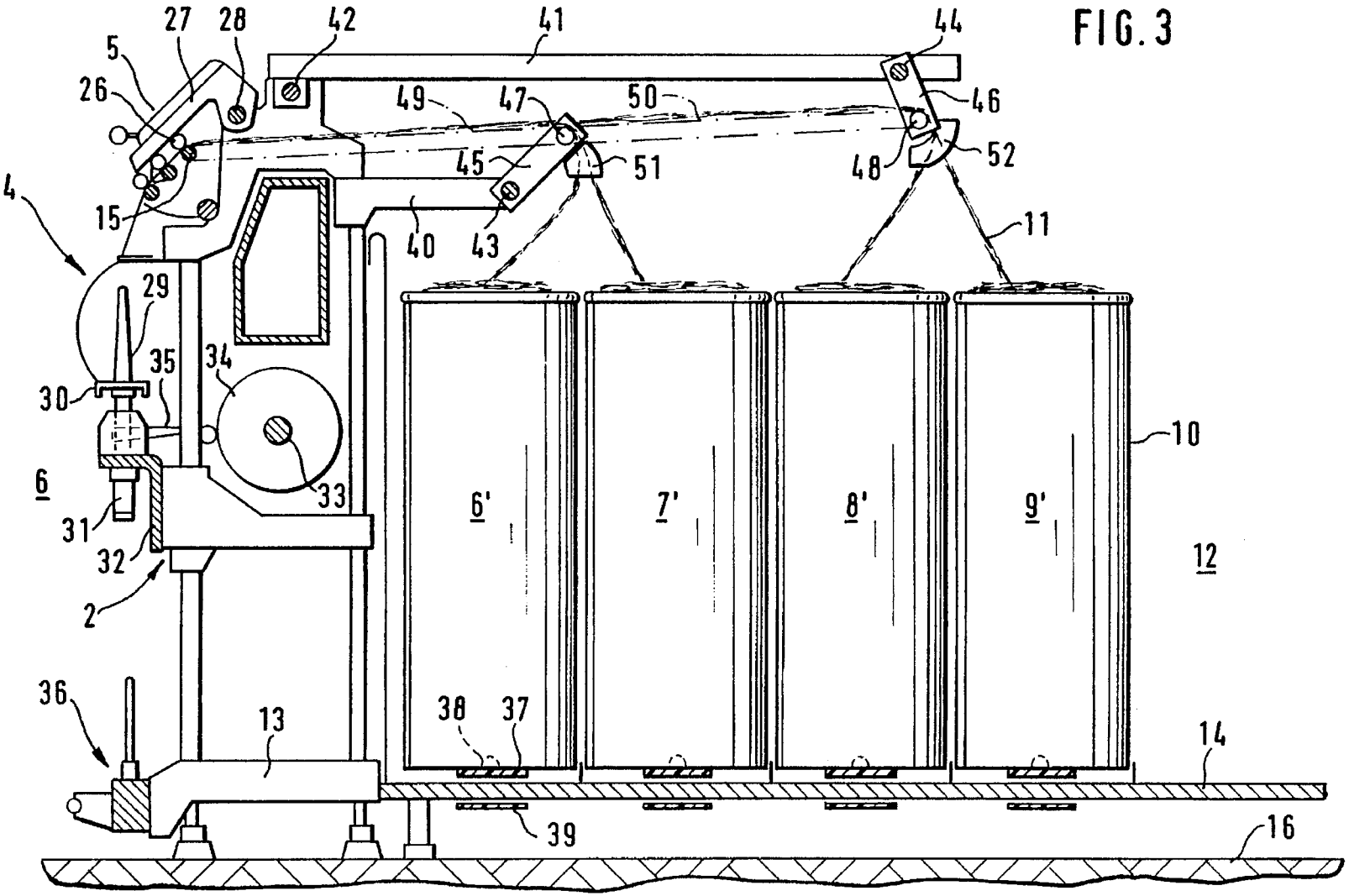
FIG. 3 is a partial view similar to FIG. 1 showing another preferred embodiment of the invention with only one ring spinning machine, transport belts for the transporting of slivers being provided between the cans and the spinning stations.

FIG. 3 is a cross-sectional view of a detail of a ring spinning machine which is a little more detailed than in FIGS. 1 and 2.

A drafting unit 5 is illustrated, the load carrier 27 of which carries the pressure rollers 26 and, as required, can be swivelled away about a holding rod 28 extending through in the longitudinal direction of the machine. Also shown is a ring spindle 29 together with the ring 30 and the spindle bearing housing 31 which is fastened on a profiled spindle rail 32 extending in the longitudinal direction of the machine. A drive shaft 33 is also illustrated which extends through in the longitudinal direction of the machine and with which driving disks are non-rotatably connected around which a driving belt 35 is wound which drives the spindles 29. Finally, the auxiliary devices for a doffing of the ring spinning machine 2 are indicated at reference number 36.

In the case of the embodiment according to FIG. 3, the depositing sites of the cans 10 are formed by a conveyor belt 37 which extends closely above the can platform 14 and has button-type elevations 38 which reach behind the normally recessed bottom of the cans 10 and thus transport the cans 10 in the case of a can exchange. For the operation of the ring spinning machine 2, the individual conveyor belts 37 assigned to rows 6 to 9 are stopped so that the cans 10 are positioned on their depositing sites pertaining to the respective spinning stations 4. The returning runs 39 of the conveyor belts 37 are guided back between the can platform 14 and the floor 16.

In the case of slivers 11 of particularly fine sizes, even a short path between the cans 10 and the 5 pertaining drafting unit 5 could become dangerous, particularly in the case of combed slivers 11. This applies particularly to the outer rows 8' and 9' of the cans 10. In the case of the inner rows 6' and 7', the situation is less dangerous.

On the ring spinning machine 2, supports 40 and 41 are mounted on the end of each machine section in the direction of the cans 10. Supports 40 are assigned to rows 6' and 7' of the cans 10 and supports 41 are assigned to rows 8' and 9' of the cans 10. The latter are correspondingly longer. The supports 41 which pertain to the outer rows 8' and 9' of the cans 10 can be swivelled upward in a manner that will be described below around a shaft 42 extending in the longitudinal direction on the ring spinning machine 2. Supports 40 are connected with one another by means of round bars 43 and supports 41 are connected with one another by means of round bars 44. The round rods or bars 43 and 44 extend in the longitudinal direction of the machine and are used as swivel shafts for roller holders 45 and 46. The roller holders 45 and 46, which are loaded by a spring which is not shown, are used for the holding of tensioning rollers 47 and 48. Tensioning rollers 47 are assigned to rows 6' and 7' and tensioning rollers 48 are assigned to rows 8' and 9' of the cans 10. Transport belts 49 and 50, which are each indicated by a dash-dotted line (also see the following description of FIG. 5 in this respect), are wound around the tensioning rollers 47 and 48. The transport belts 49 and 50 extend to the pertaining feeding roller 15 of the drafting units 5 and wind around the feeding roller 15 by which they are driven. The path of the transport belts 49 and 50 is linear; that is, it has no deflection, so that it is possible to let the transport belts 49 and 50 be driven directly by the feeding rollers 15 of the drafting units 5.

A separate transport belt 49, 50 is preferably assigned to each sliver 11. By way of feeding hoppers 51 and 52, the slivers 11 are guided to the pertaining transport belts 49 and 50 and are transported from there to the pertaining drafting units 5. As a result, faulty drafts in the slivers 11 are avoided, and the manufacturing expenditures are simplified by the linear transport path situated approximately in a horizontal plane.

The drafting units 5 have a slope of approximately 45 degrees with respect to the horizontal plane. As a result, it is possible that the transport belts 49 and 50 can run to the feeding rollers 15 underneath the holding rod 28.

Figure 5:
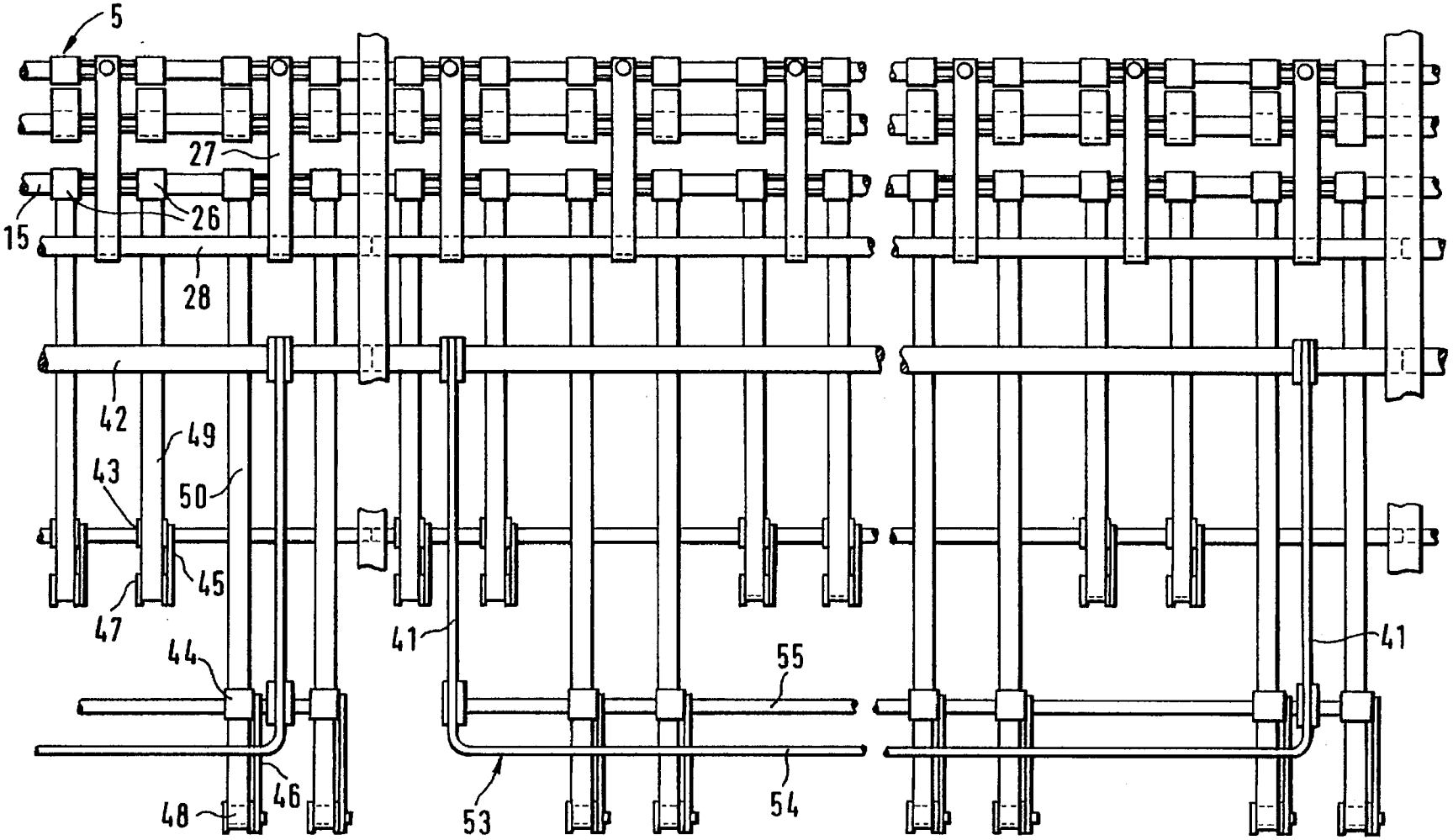
FIG. 5 is a view in the direction of arrow V of FIG. 4.

With respect to the arrangement of the transport belts 49 and 50 which have different lengths, reference is already made at this point to the description of FIG. 5 which will follow. It should be noted that the tensioning rollers 47 and 48 are constructed as pure nondrivable deflecting rollers which are situated at the point of the drivable delivery rollers 17 and 18 according to FIGS. 1 and 2.

The exchange of full cans for empty cans 10 is advantageously carried out in blocks, in which case, by means of the conveyor belts 37, the cans 10 of rows 6' and 7' are first brought to their depositing sites; then the new slivers 11 are connected with the old slivers; and only then the cans 10 of rows 8' and 9' are also brought to their depositing sites; and the ends of the old and the new slivers 11 are connected with one another. In this case, it may be difficult for the operating personnel to handle the slivers 11 of rows 6' and 7' of cans 10.

Figure 4:
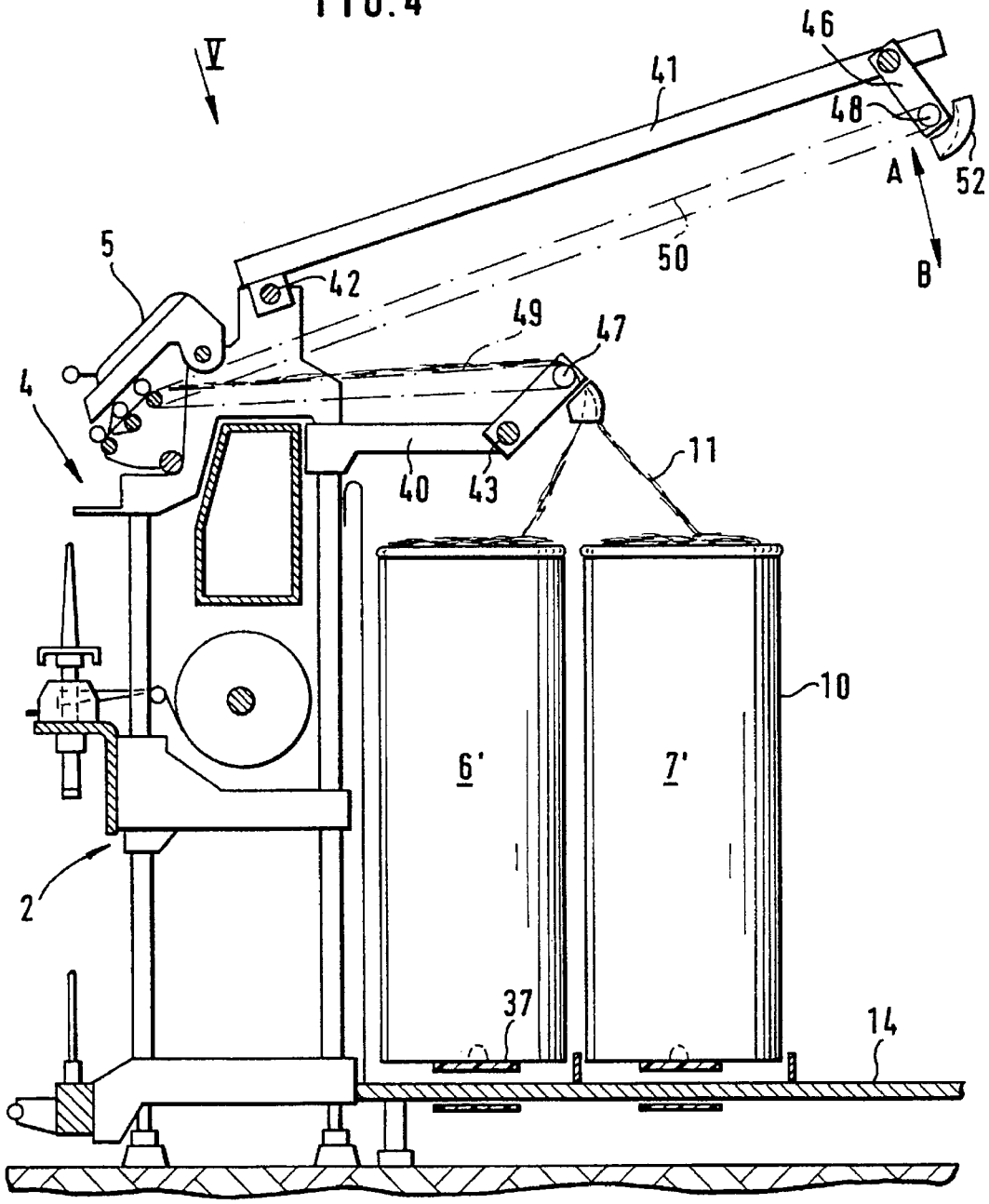
FIG. 4 is a view of the embodiment according to FIG. 3 showing the frame swivelled up for the holding of the transport belts.

For this reason, according to FIG. 4, the support 41 which is assigned to rows 8' and 9' is constructed as a frame which can be swivelled up about the shaft 42 (see swivel directions A and B). Thus, the support 41 is swivelled upward together with the tensioning rollers 48 and the transport belts 50 of at least one section of the machine so that the operating personnel can handle the slivers 11 of rows 6' and 7'. Subsequently, the support 41 is swivelled back into its operative position in the direction of the arrow B, after which the cans 10 of rows 8' and 9' are then fed to their depositing sites.

In a manner that is not shown, a locking device is provided for the swivelled-up position of the support 41 as well as for its operative position.

For an understanding of FIG. 5, which will be described in the following, reference is also made to the reference numbers of the already described FIG. 3.

It is illustrated that for a plurality of spinning stations 4, such as a machine section, the support 41 which can be swivelled upward is part of a frame 53. This frame is formed by the swivel shaft 42, two supports 41 as well as a gripping rod 54. It also carries the swivel shafts 44 for the roller holders 46 which are connected by a rod 55.

Two adjacent pressure rollers 26 respectively which pertain to a load carrier 27 are each combined to a pressure roller pair and are constructed as loose rollers. The two pressure rollers 26 of a pressure roller pair are therefore part of two different spinning stations 4.

It is illustrated that two short transport belts 49 respectively for the rows 6' and 7' of the cans 10 alternate with two long transport belts 50 for the outer rows 8' and 9' of the cans 10. In this case, it is provided that two short transport belts 49 respectively are assigned to a pressure roller pair 26, and two long transport belts 50 respectively are assigned to another pressure roller pair 26. Thus, the length of the transports belts 49 and 50 differs at each load carrier 27.

For the swivelling-up of the frame 53, the operator must only lift the gripping rod 54, whereby, in addition 5 to the long transport belts 50, the tensioning rollers 48 and their feeding hoppers 52 are also swivelled upward.

In a manner that is not shown, it is possible, by means of a central actuating device, to swivel all frames 53 of a ring spinning machine 1, 2, 3 jointly upward and bring them back into the central operating position. This is particularly advantageous in the case of an automatic exchange of cans.

In order to be able to treat the individual spinning stations 4 independently of one another, particularly for eliminating a yarn breakage, it is expedient to provide the individual tensioning rollers 47 and 48 as single tensioning rollers which are independent of the tensioning rollers of other spinning stations.

Figure 6:
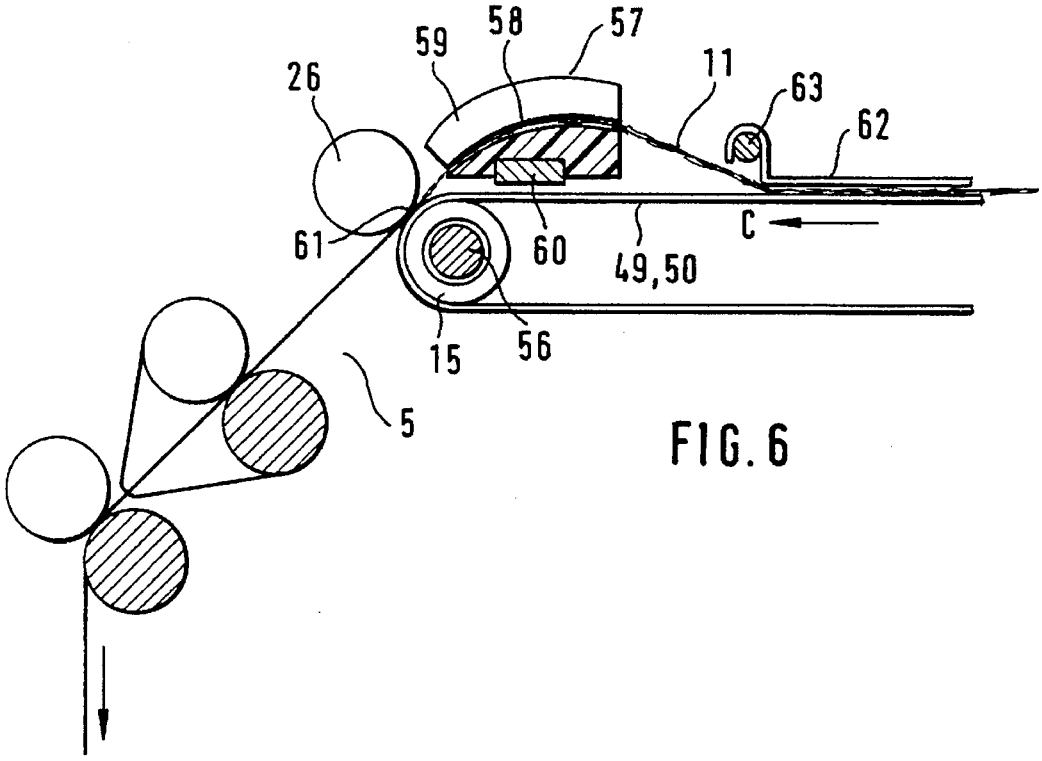
FIG. 6 is a view of a detail of FIG. 3 in the area of the transition from the transport belt to the drafting unit.

As shown in the enlarged FIG. 6, the embodiment according to FIG. 3 has the advantage that, for the feeding rollers 15 of the drafting units 5 as well as for the pertaining transport belts 49 and 50, a joint stopping device for the sliver 11 may be provided. By means of such a stopping device, an individual spinning station 4 can be stopped independently of adjacent spinning Stations, for example—controlled by a yarn detector—after a yarn breakage. When the feeding roller 15 is in a stopped state, the pertaining transport belt 49 is also stopped.

As mentioned above, the transport belt 49 and 50 runs around the pertaining feeding roller 15. As a result, the transport belt 49 and 50 is driven by the feeding roller 15. During the operation, the feeding roller 15, in turn, is non-rotatably connected with a shaft 56 which extends through in the longitudinal direction of the machine and is driven from the gearhead of the ring spinning machine 1, 2 or 3. In order to be stopped, the feeding roller 15 can be decoupled from the continuously running shaft 56, for example, by means of a coupling, as it is described in the German Patent Application P 41 24 312.9. As a result, the transport belt 49, 50, which during the operation runs into the direction of the arrow C, can be stopped.

Directly in front of the feeding roller 15, a feeding hopper 57 is provided which has a convex surface 58 as well as side cheeks 59 with respect to the sliver 11.

The transport belt 49 and 50 does not hinder the mounting of the feeding hopper 57 of t feeding hoppers 57 of the individual spinning stations 4 are fitted onto a rail 60 extending through in the longitudinal direction of the machine. The rail 60 extends closely above the transport belts 49, 50 and is disposed directly in front of the feeding rollers 15.

It is harmless that the individual slivers 11, shortly before travelling into the drafting unit 5, lift slightly off the pertaining transport belt 49 or 50 and in the process are deflected upward. Along a very short path to the first nip line 61 of the drafting unit 5, the effect of the transport belt 49, 50 on the sliver 11 is cancelled. This can be accepted without any difficulties.

The individual slivers 11 are pressed by means of a skid 62 against the pertaining transport belt 49, 50. The skid 62 is suspended in the area of the feeding hopper 57 on a rod 63 extending in the longitudinal direction of the machine. The skids 62 load the slivers 11 with a slight contact pressure against the transport belt 49, 50 and thereby stretch the slivers 11. At the same time, the skids 62 are used as a shield against damaging side air.

The feeding hoppers 57 are advantageously open toward the top, whereby the pulling-in of the slivers 11 is facilitated.

Figure 7:
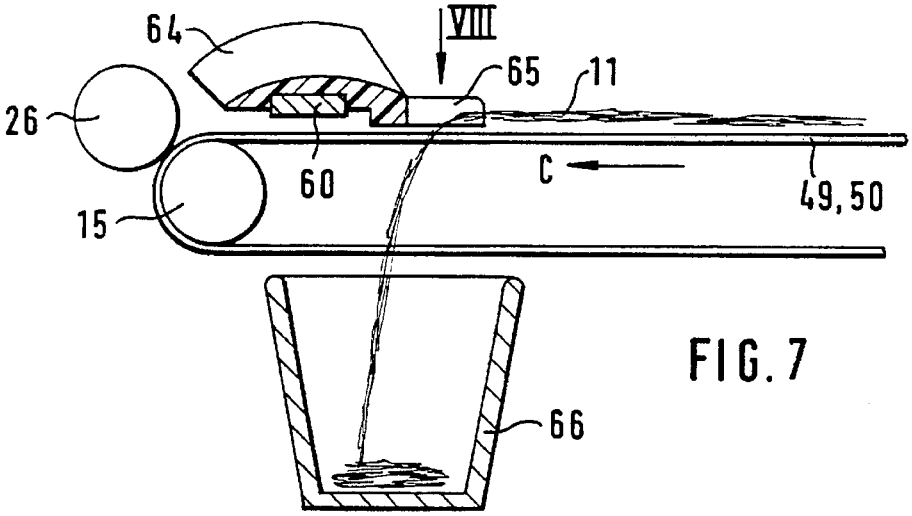
FIG. 7 is a view similar to FIG. 6 in a modified embodiment.
Figure 8:
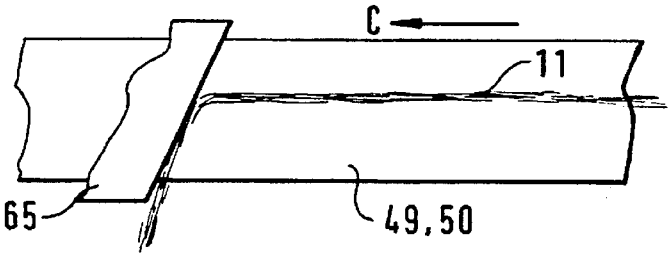
FIG. 8 is partial view in the direction of the arrow VIII of FIG. 7.

The embodiment according to FIG. 7 is based on the fact that the feeding rollers 15 and thus the transport belts 49, 50 cannot be stopped separately. The feeding hopper 64, which is shown here and is also mounted on a longitudinal rail 60, is connected with a sliver deflector 65. The sliver deflector 65 is placed very lightly against the pertaining transport belt 49, 50. In a top view according to FIG. 8, it has a slightly oblique adjustment. When, from the direction of the can aisle 12, after a change of batches, a new sliver 11 is placed on the pertaining transport belt 49, 50, no waiting is required in the servicing aisle 6 in order to thread the sliver 11 into the feeding hopper 64. On the contrary, the sliver 11, deflected by the sliver deflector 65, travels laterally into a trough 66. Then an operator can cut the sliver 11 situated in the trough 66 off the excess remainder and thread it into the drafting unit 5.

A one-sided ring spinning machine 1, 2 or 3 of the above-mentioned type has numerous advantages with respect to the direct spinning of slivers 11 fed in cans 10 into yarns. In many cases, the described transport belts 49 and 50 are not required, particularly when medium or coarser sizes of slivers 11 are fed. In order to avoid faulty drafts, particularly in the case of finer slivers 11, however, the transport belts 49 and 50 are useful.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A ring spinning machine comprising:

a longitudinally extending front machine side facing a machine operating aisle, a longitudinally extending rear machine side facing oppositely of the front machine side, a plurality of spinning stations arranged only on the front machine side, said spinning stations being arranged next to one another in a row, each of said spinning stations including a drafting unit followed by a ring spindle, each drafting unit having a drivable feeding roller at a drafting unit inlet side thereof, a plurality of sliver can depositing sites for depositing sliver cans containing sliver to be spun, said can depositing sites being arranged on the rear machine side, and a sliver conveying system for conveying sliver from respective sliver cans at the can depositing sites to respective drafting units of the spinning stations, said sliver conveying system including a driven deflecting roller disposed above the respective can depositing sites and defining a substantially horizontal sliver travel path between respective deflecting rollers and respective ones of the drafting unit feeding rollers, thereby providing short sliver transport path length between the driven deflecting roller and respective drafting unit feeding rollers so as to substantially avoid damaging free hanging lengths of slivers.

2. A ring spinning machine according to claim 1, wherein the can depositing sites include a plurality of rows of can depositing sites, and wherein the sliver conveying system includes a plurality of driven defecting rollers disposed above different rows of said can depositing sites.

3. A ring spinning machine according to claim 1, wherein said sliver can depositing sites are configured for cans containing sliver of the size from 0.3 Nm to 0.8 Nm.

4. A ring spinning machine according to claim 1, wherein the depositing sites are on a can platform elevated with respect to a bottom of the ring spinning machine.

5. A ring spinning machine according to claim 1, wherein an outside diameter of the cans amounts to maximally 300 mm.

6. A ring spinning machine according to claim 1, wherein the height of the drivable feeding rollers of the drafting units as measured from a floor of the ring spinning machine amounts to maximally 1.4 meters.

7. A ring spinning machine according to claim 1, wherein the deflecting guide is a delivery roller.

8. A ring spinning machine according to claim 1, wherein the deflecting guide is a deflecting roller driven by a drivable transport belt.

9. A ring spinning machine according to claim 8, wherein the transport belt has a linear course and extends at least approximately to the drivable feeding roller of the drafting unit.

10. A ring spinning machine according to claim 9, wherein the transport belt winds around the drivable feeding roller and is driven by the feeding roller.

11. A ring spinning machine according to claim 8, wherein the transport belt has a shield against side air.

12. A ring spinning machine according to claim 11, wherein the shield is constructed as a skid.

13. A ring spinning machine according to claim 8 wherein the deflecting roller is mounted on an upwardly swivelable frame.

14. A ring spinning machine according to claim 8, wherein the deflecting roller is a component of a tensioning device tensioning the transport belt.

15. A ring spinning machine according to claim 1, wherein the drivable feeding rollers of the drafting units are arranged adjacent to the rear side of the ring spinning machine.

16. A ring spinning machine according to claim 1, wherein the drafting units are arranged at a slope of approximately 45 degrees with respect to the horizontal plane.

17. A ring spinning machine according to claim 10 wherein the drivable feeding rollers of the drafting units are decouplable rollers which are adapted to be decoupled from a drive shaft.

18. A ring spinning machine according to claim 17, wherein the pressure rollers of the drafting units pertaining to the drivable feeding rollers are constructed as idler rollers of a pressure roller pair.

19. A ring spinning machine according to claim 8, wherein one feeding hopper respectively is connected in front of the drivable feeding rollers for lifting the sliver off the transport belt.

20. A ring spinning machine according to claim 8, wherein a sliver deflector is assigned to the running transport belt.

21. A ring spinning machine according to claim 1, wherein the depositing sites of the cans are arranged on a conveyor belt.

22. A ring spinning machine according to claim 1, wherein an air-conditioning duct provides air-conditioned air to the depositing sites of the cans.

23. A ring spinning machine according to claim 22, wherein the air-conditioning duct is arranged in an air-conditioning tunnel which covers the depositing sites of cans that are situated between two ring spinning machines.

24. A ring spinning machine according to claim 4, wherein the outside diameter of the cans amounts to maximally 300 mm.

25. A ring spinning machine according to claim 24, wherein the height of the drivable feeding rollers of the drafting units as measured from a floor of the ring spinning machine amounts to maximally 1.4 meters.

26. A ring spinning machine according to claim 25, wherein the deflecting guide is a delivery roller.

27. A ring spinning machine according to claim 10, wherein the transport belt is provided with a shield against side air.

28. A ring spinning machine according to claim 27, wherein the shield is constructed as a skid.

29. A ring spinning machine according to claim 10, wherein the deflecting roller is mounted on an upwardly swivellable frame.

30. A ring spinning machine according to claim 10, wherein the deflecting roller is a component of a tensioning device tensioning the transport belt.

31. A ring spinning machine according to claim 29, wherein the deflecting roller is a component of a tensioning device tensioning the transport belt.

32. A ring spinning machine according to claim 17, wherein one feeding hopper respectively is connected in front of the drivable feeding rollers for lifting the sliver off the transport belt.

33. A ring spinning machine according to claim 32, wherein a sliver deflector is assigned to the running transport belt.

* * * * *